US007580008B2

(12) United States Patent
Kang

(10) Patent No.: US 7,580,008 B2
(45) Date of Patent: Aug. 25, 2009

(54) METHOD AND APPARATUS OF DRIVING PLASMA DISPLAY PANEL

(75) Inventor: Tae-Kyoung Kang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 646 days.

(21) Appl. No.: 11/176,272

(22) Filed: Jul. 8, 2005

(65) Prior Publication Data

US 2006/0028404 A1 Feb. 9, 2006

(30) Foreign Application Priority Data

Aug. 5, 2004 (KR) ..... 10-2004-0061674

(51) Int. Cl.
*G09G 3/28* (2006.01)

(52) U.S. Cl. ..... 345/60

(58) Field of Classification Search ..... 345/60, 345/66, 68, 169.4, 37, 38, 39, 40, 63, 204, 345/208, 209, 210; 313/582, 484; 315/169.1, 315/169.2, 169.3, 169.4; 348/797, 800
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Sinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |

(Continued)

FOREIGN PATENT DOCUMENTS

| | | |
|---|---|---|
| JP | 02-148645 | 6/1990 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Abbas I Abdulselam
(74) *Attorney, Agent, or Firm*—Robert E. Bushnell, Esq.

(57) ABSTRACT

A method of driving a plasma display panel (PDP) and an apparatus for carrying out the method. The PDP includes address electrodes with first electrodes and second electrodes intersecting the address electrodes. Gray-scale levels being represented by combinations of sub-fields, each sub-field having a reset period, an address period, and a sustain-discharge period. The different gray scales are achieved not only by modifying the voltage waveforms in the sustain-discharge period but also by modifying the voltage waveforms in the reset period, allowing for better control over gray scales and better contrast. Different sub-fields can have different voltages applied during the reset period which affects the luminance of the image displayed. A circuit for making the above voltage waveforms is also presented.

20 Claims, 8 Drawing Sheets

U.S. PATENT DOCUMENTS

| | | | | |
|---|---|---|---|---|
| 6,630,916 | B1 | 10/2003 | Shinoda | |
| 6,707,436 | B2 | 3/2004 | Setoguchi et al. | |
| 7,321,346 | B2 * | 1/2008 | Jung et al. | 345/68 |
| 7,329,990 | B2 * | 2/2008 | Park | 313/586 |

FOREIGN PATENT DOCUMENTS

| | | |
|---|---|---|
| JP | 09-325736 | 12/1997 |
| JP | 2845183 | 10/1998 |
| JP | 11-065517 | 3/1999 |
| JP | 2917279 | 4/1999 |
| JP | 2001-043804 | 2/2001 |
| JP | 2001-325888 | 11/2001 |
| JP | 2003-050562 | 2/2003 |
| JP | 2003-050563 | 2/2003 |
| JP | 2003-076323 | 3/2003 |
| JP | 2003-280575 | 10/2003 |
| JP | 2003-345292 | 12/2003 |
| JP | 2004157291 | 6/2004 |

OTHER PUBLICATIONS

Japanese Office Action in corresponding Japanese Patent Application No. 2005-170742 issued on Dec. 16, 2008.

* cited by examiner

METHOD AND APPARATUS OF DRIVING PLASMA DISPLAY PANEL

CLAIM OF PRIORITY

This application makes reference to, incorporates the same herein, and claims all benefits accruing under 35 U.S.C. §119 from an application for METHOD AND APPARATUS FOR DISPLAYING PICTURES ON PLASMA DISPLAY PANEL earlier filed in the Korean Intellectual Property Office on Aug. 5, 2004 and there duly assigned Serial No. 10-2004-0061674.

BACKGROUND OF THE INVENTION

1. Field of the Invention

The present invention relates to a method of driving a plasma display panel (PDP) for displaying images by applying discharge pulses to an electrode structure forming display cells with color phosphors thereon, and more particularly, to a method of driving a plasma display panel (PDP), allowing various gray-scale displays by combinations of light intensities respectively discharged during reset periods, address periods, and sustain-discharge periods of a plurality of sub-fields and a circuit thereof.

2. Description of the Related Art

In a PDP, intensity gray scale is achieved by forming discharges during a sustain discharge period. However, discharges also occur during the reset period and the address period. During the reset period, the discharge occurs whether or not the particular discharge cell has been selected. Because of this, even when a pixel is not selected and should result in a black display, some light is actually displayed because of the discharges that occur during the reset period. This results in reduced contrast as portions of the display that are supposed to be entirely black are not actually dark. Also, this discharge during the reset period in non-selected cells also limits the number of gray scale gradations that can occur for each pixel. Therefore, what is needed is an improved method of applying voltages to the electrodes can reduce as well as vary the amount of discharge created during the reset period so that better contrast can be achieved and a more efficient gray scale scheme can be developed.

SUMMARY OF THE INVENTION

It is therefore an object of the present invention to provide an improved driving method for a PDP.

It is also an object to provide a method of driving a PDP that results in less discharge during the reset period.

It is still an object of the present invention to provide a method of driving a PDP that results in less discharge and thus less light generated in non-selected pixels.

It is further an object of the present invention to provide a method of driving a PDP that results in improved image contrast.

It is yet an object of the present invention to provide a method of driving a PDP that results in a more efficient gray scale.

It is still an object of the present invention to provide a circuit that drives the PDP that results in less light being generated in non-selected discharge cells.

It is also an object of the present invention to provide a circuit used in driving a PDP that results in improved image contrast and a more efficient gray scale.

It is yet an object of the present invention to provide a PDP driving method capable of variously and finely representing gray-scale levels of a PDP.

It is further an object of the present invention to provide a PDP driving method capable of effectively and finely representing images in low gray-scale.

It is still an object of the present invention to provide a plasma display panel driving method capable of enhancing contrast by making black light darker.

These and other objects may be achieved by a PDP that includes address electrodes, first electrodes and second electrodes intersecting the address electrodes, with gray-scale levels being represented by combinations of sub-fields, each sub-field having a reset period, an address period, and a sustain-discharge period. During the reset period, a rising ramp-shaped pulse starting from a is reset start voltage is applied to the first electrodes and then a falling ramp-shaped pulse starting from the reset start voltage is applied to the first electrodes. During the address period, address data is applied to the address electrodes, and a scan pulse changing between a scan high voltage and a scan low voltage is sequentially applied to the first electrodes so that address discharges occur and discharge cells are selected. During the sustain-discharge period, a pulse of a sustain voltage is alternately applied to the first electrodes and the second electrodes, so that sustain discharges occur in the selected discharge cells.

In a PDP driving method according to an embodiment of the present invention, in which gray-scale levels are represented by sub-fields each including a reset period, an address period, and a sustain discharge period, by variously setting a rising ramp start voltage of the reset period and thus reducing luminous brightness through reset-discharging, it is possible to variously represent gray-scale levels and enhance contrast.

A reset start voltage of the first type sub-field is lower than the reset start voltage of the second type sub-field. The reset start voltage of the second type sub-field is the same as the sustain voltage. The reset start voltage of the first type sub-field is the same as the scan high voltage. In a unit discharge cell, reset light emitted during the reset period of the first type sub-field is less than reset light emitted during the address period of the second type sub-field.

In the unit discharge cell, if the minimum level of sustain light emitted during the sustain discharge period is 4 units, a level of address light emitted during the address period is 2 units, a level of reset light emitted during the reset period in the second type sub-field is 4 units, and a level of reset light emitted during the reset period in the first type sub-field is less than 4 units and is preferably 2 units.

An image of an unit frame is created by combinations of first type sub-fields and second type sub-fields, and brightness of light emitted per each unit frame is determined by combinations of reset light levels of the first type sub-fields and reset light levels of the second type sub-fields and selective combinations of the address light and the sustain light.

According to another aspect of the present invention, there is provided a computer-readable medium having embodied thereon a computer program for executing the method.

According to still another aspect of the present invention, there is provided an apparatus of driving a PDP, the apparatus including a main switch connected to a first electrode of the PDP, first, second, third, and fourth switches connected to one end of the main switch, switching first, second, third, and fourth power sources, respectively, a fifth power source, a first capacitor connected between the one end of the main switch and the fifth power source, a fifth switch connected between the other end of the main switch and the fifth power source, and a sixth switch, connected to the one end of the main switch, switching a sixth power source.

During a reset period, when the fifth switch is turned on, one of the first switch and the third switch is turned on, the other of the first switch and the third switch is turned off, and the second, fourth, and sixth switches are turned off. During an address period, the third and fourth switches are selectively turned on and off, and during an sustain-discharge period, the first and second switches are alternately on/off controlled. The voltage of the third power source is lower than the voltage of the first power source. The voltage of the first power source is the same as the sustain voltage.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
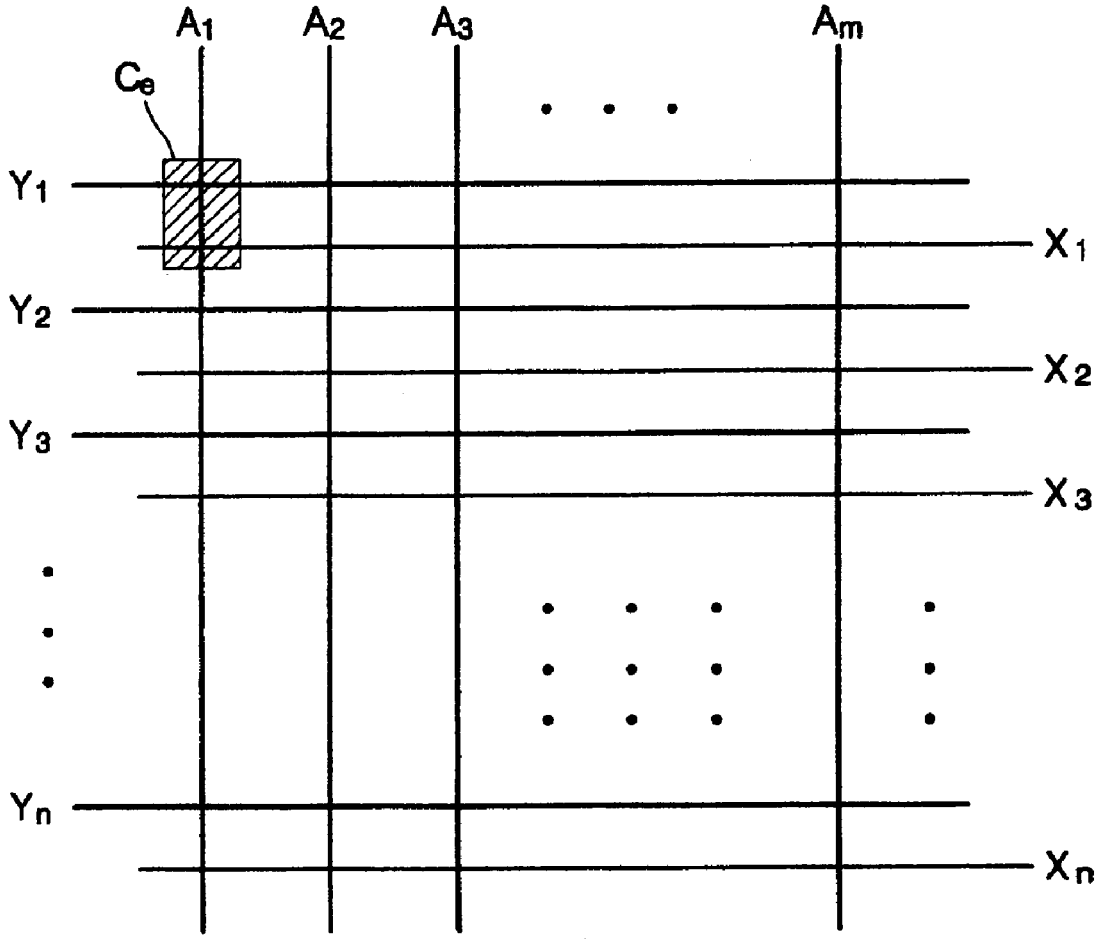
FIG. 1 is a plan schematically illustrating an electrode arrangement of a plasma display panel (PDP)

Turning now to the figures, FIG. 1 is a plan view schematically illustrating an electrode arrangement of a plasma display panel (PDP). Referring to FIG. 1, scanning electrode lines Y1, Y2, . . . , Yn and common electrode lines X1, X2, . . . , Xn are arranged in parallel to each other on the PDP, the scanning electrode lines and the common electrode lines are also referred to as sustain electrode lines. Address electrode lines A1, A2, . . . , Am are arranged to intersect the scanning electrodes lines Y1, Y2, . . . , Yn and the common electrode lines X1, X2, . . . , Xn. Discharge cells are partitioned and formed by barrier ribs in portions which the sustain electrode lines intersect the address electrode lines A1, A2, . . . , Am. Each discharge cell Ce acts as a pixel of the PDP. R/G/B phosphor material and plasma forming gas are filled in the internal space of the discharge cell Ce, and wall charges are formed inside the discharge cell Ce by voltages respectively applied to a corresponding scanning electrode, a corresponding common electrode, and a corresponding address electrode. Plasma is generated from the plasma forming gas by the wall charges and the phosphor in the discharge cell Ce is excited by ultraviolet radiation occurring from the plasma, thus emitting visible light. From now on, the scanning electrode lines Y1, Y2, . . . , Yn will be referred to as Y electrode lines, and common electrode lines X1, X2, . . . , Xn will be referred to as X electrode lines.

Figure 2:
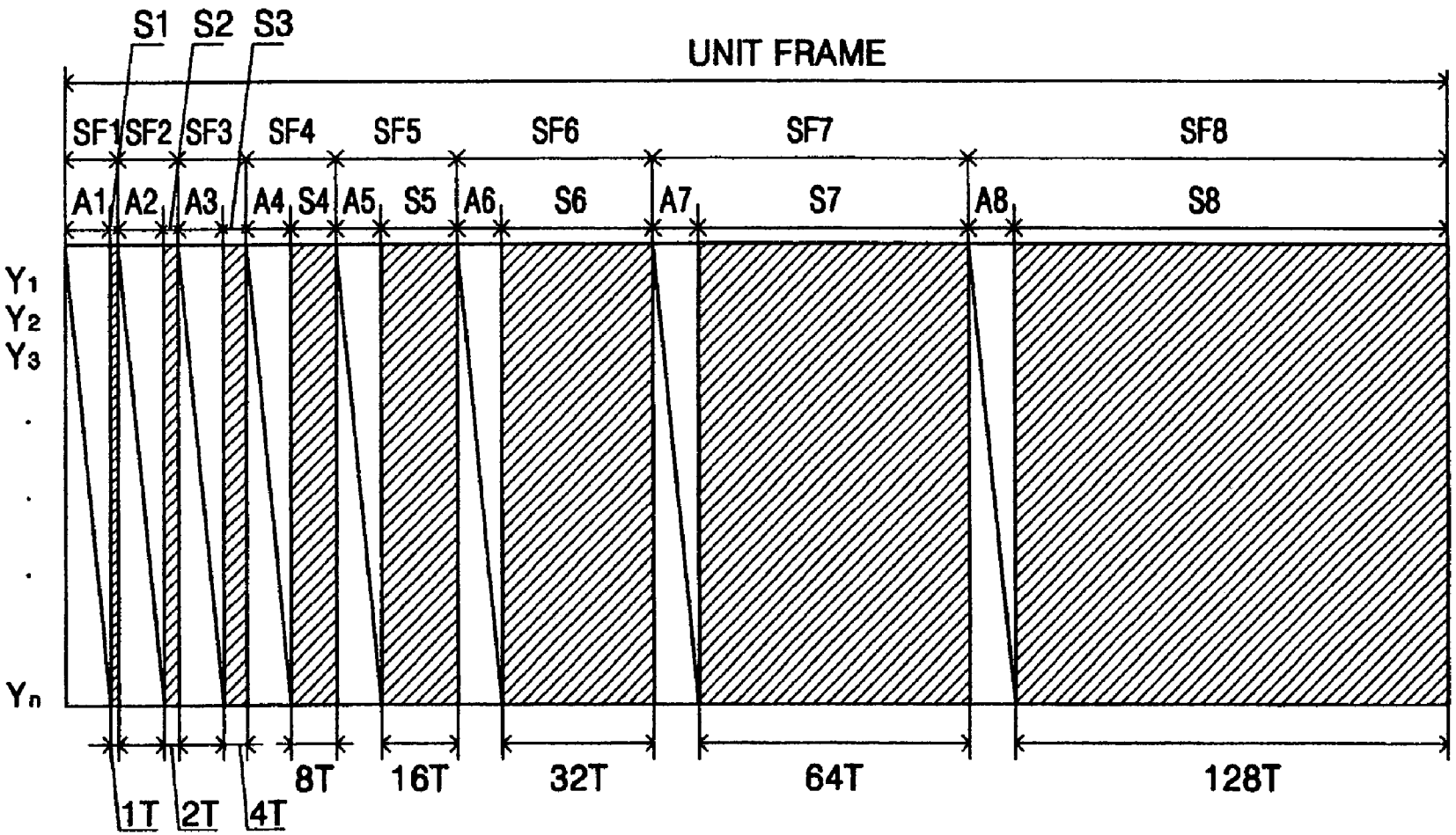
FIG. 2 is a view for explaining an address-display separation driving method of driving Y electrode lines of a PDP.

Meanwhile, U.S. Pat. No. 5,541,618 to Shinoda discloses an address-display separation driving method which is widely used as a PDP driving method. As illustrated in FIG. 2, FIG. 2 is a view for explaining an address-display separation driving method of driving Y electrode lines of a PDP. Referring to FIG. 2, a unit frame can be divided into a predetermined number of sub-fields, for example, 8 sub-fields SF1, . . . , SF8, in order to implement time division gray-scale display. Also, the respective sub-fields SF1, . . . , SF8 are respectively divided into reset periods (not illustrated), address periods A1, . . . , A8, and sustain-discharge periods S1, . . . , S8.

During the respective address periods A1, . . . , A8, a display data signal is applied to the address electrode lines (AR1, AG1, . . . , AGm, ABm of FIG. 2) and simultaneously corresponding scanning pulses are sequentially applied to the respective Y electrode lines Y1, . . . , Yn. During the respective sustain-discharge periods S1, . . . , S8, a display discharge pulse is alternately applied to the Y electrode lines Y1, . . . , Yn and X electrode lines X1, . . . , Xn so that display discharges occur in discharge cells in which wall charges have been formed during the address periods A1, . . . , A8.

The brightness of a PDP is proportional to the number of sustain pulses applied during sustain discharge periods S1, . . . , S8 in a unit frame. If a frame forming one image is displayed by 8 sub-fields in 256 gray-scales, different numbers (1, 2, 4, 8, 16, 32, 64, and 128) of sustain pulses can be sequentially assigned to the respective sub-fields. In order to obtain the brightness of a 133 gray-scale level, during the periods of a first type sub-field (SF1), a third sub-field (SF3), and an eighth sub-field (SF8) cells must be addressed and sustain-discharged.

The number of sustain-discharges (sustain-discharge pulses) assigned to each sub-field depends on a weight of the sub-field based on APC (Automatic Power Control). Alternately, the number of sustain-discharges assigned to each sub-field can be variously set considering gamma characteristics or panel characteristics. For example, it is possible to decrease a gray-scale level assigned to a fourth sub-field (SF4) from 8 to 6 and increase a gray-scale level assigned to a sixth sub-field (SF6) from 32 to 34. Also, the number of sub-fields forming one frame can also be set according to a design rule.

Figure 3:
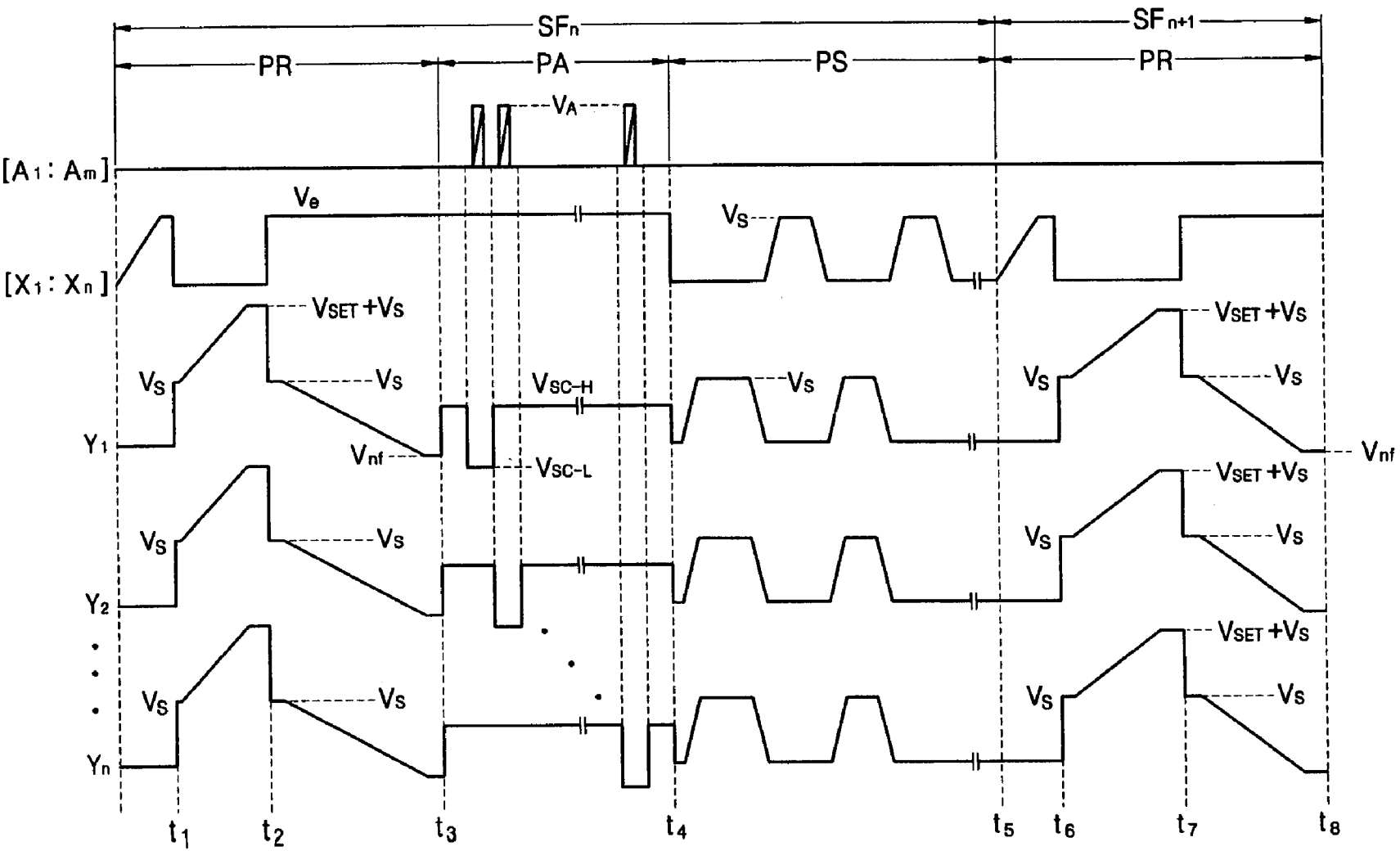
FIG. 3 is a timing diagram of an exemplary driving signal for driving a PDP.

Turning now to FIG. 3, FIG. 3 is a timing diagram of an exemplary driving signal for driving a PDP. FIG. 3 illustrates a driving signal applied to address electrodes A1 through Am, common electrodes X1 through Xn, and scanning electrodes Y1 through Yn during a sub-field SF according to an ADS driving method of an AC PDP. Referring to FIG. 3, a sub-field SF includes a reset period PR, an address period PA, and a sustain-discharge period PS.

During the reset period PR, a reset pulse is applied to all groups of scanning lines so that write discharges are compulsorily performed, thus initializing the states of wall charges in all cells. Even when a cell is not about to be selected and used for display, that cell is still subject to the reset pulse and thus the reset voltage. The reset period PR is performed over the whole screen before the address period PA, so that the wall charges in all cells can be uniformly distributed. That is, between cells initialized during the reset period PR, the states of wall charges therein are similar.

After the reset period PR is performed, the address period PA is performed. During the address period PA, a bias voltage Ve is applied to the common electrodes X1 through Xn. Also during the address period PA, the scanning electrodes Y1 through Yn and the address electrodes A1 through Am placed at the locations of cells to be displayed are simultaneously turned on, so that display cells are selected. During the address period PA, a negative scanning pulse is applied to the scanning electrodes Y1 through Yn and an address data voltage $V_A$ is applied to the address electrodes A1 through Am, so that address discharges occur.

After the address period PA is the sustain-discharge period PS. During the sustain-discharge period PS, a sustain pulse is alternately applied to the common electrodes X1 through Xn and the scanning electrodes Y1 through Yn so that a sustain-discharge can occur. Discharge cells are selected and sustain discharges occur by the distribution (a large amount of negative charges accumulated near the scanning electrodes Y1 through Yn) of wall charges formed during the address discharge. During the sustain-discharge period PS, phosphors located near the address electrodes A1 through Am are excited by ultraviolet radiation generated because of the discharge between the scanning electrodes Y1 through Yn and the common electrodes X1 through Xn, thus emitting visible light. During the sustain-discharge period PS, a low voltage $V_G$ is applied to the address electrodes A1 through Am. The brightness of a PDP depends on the number of sustain-discharge pulses. As the number of sustain-discharge pulses included in one sub-field or in one TV field increases, the brightness of the PDP increases.

For example, when measuring light intensity of a PDP being driven according to the timing diagram of FIG. 3, light intensity of reset light is 0.4 Cd/m$^2$, light intensity of address light is 0.2 Cd/m$^2$, and light intensity of sustain light generated by a minimum sustain pulse allowing a sustain discharge is 0.4 Cd/m$^2$. Accordingly, the reset light of 0.4 Cd/m$^2$ is essentially generated in each discharge cell for each sub-field, the address light of 0.2 Cd/m$^2$ is selectively generated, and the sustain light of $0.4K\times2^{m-1}$ Cd/m$^2$ is generated when the address light is generated. In the technique of FIG. 3, discharge light intensity or brightness (or level of light or luminance) capable of representing gray-scale levels in a unit sub-field can be expressed by the following Equation (1):

$$F(\text{gray level})=F1(n)+F2(n)+F3(n) \quad \text{Equation (1);}$$

where

F1(n)=0.4 Cd/m$^2$

F2(n)=0.2 A Cd/m$^2$, where A=0 or 1

F3(n)=$0.4K\times2^{m-1}$ Cd/m$^2$, where K and m are weights corresponding to sub-fields Generally, 8 or more unit sub-fields form one unit frame. A user sees a certain image through his/her eyes in actual brightness corresponding to a sum of light intensities and brightnesses discharged from the respective unit sub-fields included in a unit frame (1 Frame).

For example, as illustrated in FIG. 2, in a unit frame consisting of 8 sub-fields, reset light F1(n) of 8×0.4 Cd/m$^2$ is emitted, and address light F2(n) of 8×0.2 A Cd/m$^2$ and sustain light F3(n) of $8\times0.4K\times2^{m-1}$ Cd/m$^2$ are selectively emitted according to gray-scale levels.

However, in the PDP driving method of FIGS. 2 and 3, since the reset light F1(n) is always generated and hence only the address light F2(n) and the sustain light F3(n) define a gray-scale level, gray-scale levels capable of being represented are limited in diversity. Also, the contrast of a displayed image is limited by the fact that black light is not entirely dark. With the PDP driving method of FIGS. 2 and 3, since reset light of minimum 8×0.4 Cd/m$^2$ must be essentially discharged for each unit frame, contrast is poor.

Figure 4:
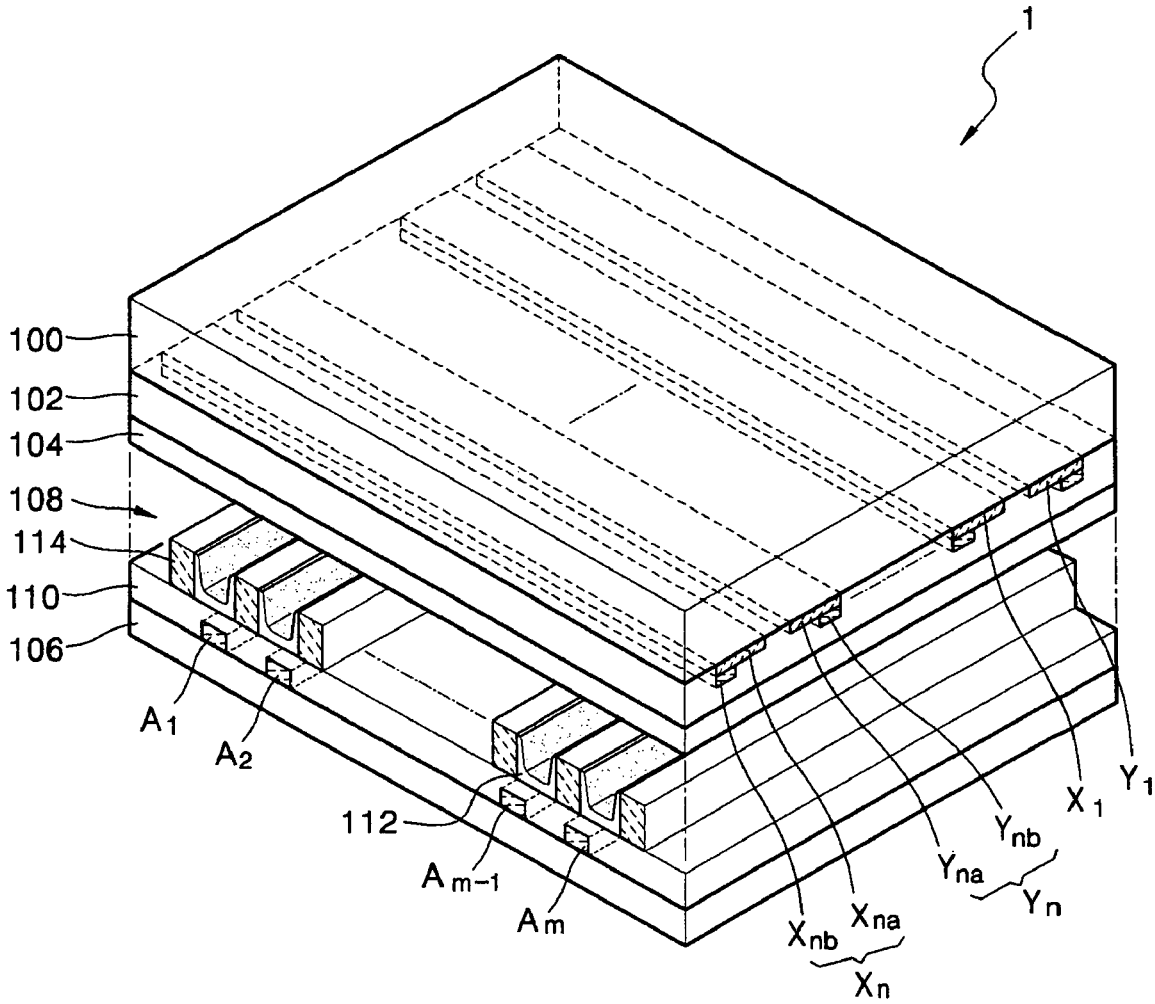
FIG. 4 is a perspective view illustrating a PDP.

Turning now to FIG. 4, FIG. 4 is a perspective view illustrating a PDP 1. Referring to FIG. 4, address electrode lines A1, A2, . . . , Am, first and second dielectric layers 102 and 110, Y electrode lines Y1, Y2, . . . , Yn, X electrode lines X1, X2, . . . , Xn, a phosphor layer 112, barrier ribs 114, and a MgO layer 104 as a protection layer, are provided between a first substrate 100 and a second substrate 106 of the PDP 1.

The address electrode lines A1, A2, . . . , Am are arranged with a predetermined pattern on a side of the second substrate 106 facing the first substrate 100. The second dielectric layer 110 covers the address electrode lines A1, A2, . . . , Am. The barrier ribs 114 are formed on the second dielectric layer 110 to be parallel to the address electrode lines A1, A2, . . . , Am. The barrier ribs 114 demarcate discharge areas of discharge cells and prevent optical interference between the respective discharge cells. The phosphor layer 112 is formed between the barrier ribs 114 on the second dielectric layer 110 over the address electrode lines A1, A2, . . . , Am, and consists of a red-emitting phosphor layer, a green-emitting phosphor layer, and a blue-emitting phosphor layer sequentially applied.

The X electrode lines X1, X2, . . . , Xn and the Y electrode lines Y1, Y2, . . . , Yn are formed with a predetermined pattern on a side of the first substrate 100 facing the second substrate 106, and running in a direction that is orthogonal to the address electrode lines A1, A2, . . . , Am thus intersecting or crossing over the address electrode lines. Each intersection forms a corresponding discharge cell. Each of the X electrode lines X1, X2, . . . , Xn may be a combination of a transparent electrode Xna formed of transparent conductive material such as ITO (Indium Tin Oxide) and a metal electrode Xnb for increasing conductivity. Each of the Y electrode lines Y1, Y2, . . . , Yn may be also a combination of a transparent electrode Yna formed of transparent conductive material such as ITO and a metal electrode Ynb for increasing conductivity. The first dielectric layer 102 is applied all over the X electrode lines X1, X2, . . . , Xn and the Y electrode lines Y1, Y2, . . . , Yn. The protection layer 104 for protecting the panel from a strong electric field, for example, an MgO layer is applied all over the first dielectric layer 102. Gas for generating plasma is filled in a discharge space 108 and the discharge space 108 is sealed.

In a PDP driving method, which is widely applied to PDPs, a resetting operation, an addressing operation, and a sustain-discharge operation are sequentially performed in each unit sub-field. During the resetting operation, charges in discharge cells to be driven are uniformly distributed. During the addressing operation, the states of charges in discharge cells to be selected and the states of charges in discharge cells not to be selected are set. During the sustain-discharge operation, sustain-discharges are performed on selected discharge cells. At this time, plasma is generated from the plasma forming gas in the discharge cells on which sustain-discharges are performed and the phosphor layers of the discharge cells are excited by ultraviolet radiation generated by the plasma, thus emitting visible light. The PDP driving method according to the present invention is not applied only to PDPs with the structure described above, but also applied to all types of PDPs capable of being driven by an arbitrary driving waveform having a reset period.

Figure 5:
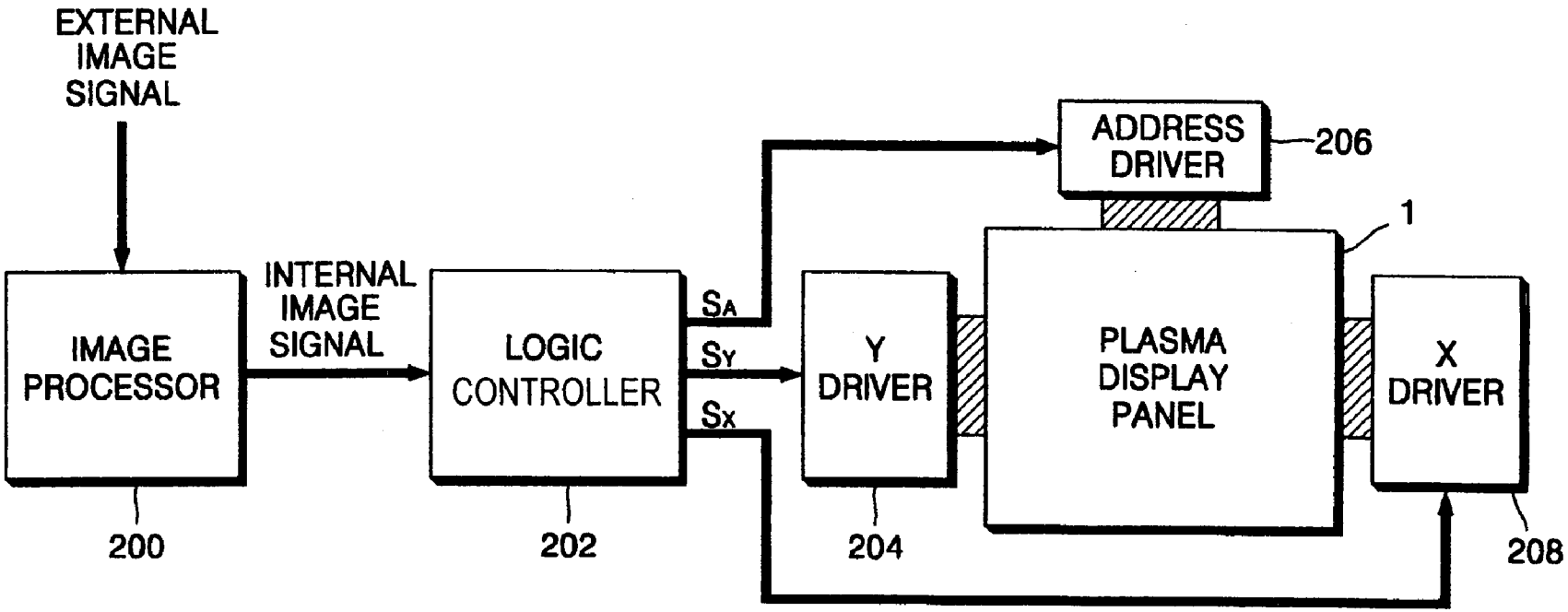
FIG. 5 is a block diagram of a driving apparatus of driving a PDP.

Turning now to FIG. 5, FIG. 5 is a block diagram of a driving apparatus of driving a PDP. Referring to FIG. 5, the PDP driving apparatus includes an image processor 200, a logic controller 202, an address driver 206, an X driver 208, an a Y driver 204. The image processor 200 converts an external image signal into a digital signal, and generates an internal image signal, for example, R/G/B image data, a clock signal, or horizontal and vertical synchronization signals, each having 8 bits. The logic controller 202 generates driving control signals $S_A$, $S_Y$, and $S_X$ in response to the internal image signal received from the image processor 200. The address driver 206 processes the address driving control signal $S_A$ among the driving control signals $S_A$, $S_Y$, and $S_X$ received from the controller 202 to thus generate a display data signal, and applies the generated display data signal to the address electrode lines. The X driver 208 processes the X driving control signal $S_X$ among the driving control signals $S_A$, $S_Y$, and $S_X$ received from the logic controller 202, and applies the processed result to the X electrode lines. The Y driver 204 processes the Y driving control signal $S_Y$ among the driving control signals $S_A$, $S_Y$, and $S_X$ received from the controller 202 and applies the processed result to the Y electrode lines.

Figure 6:
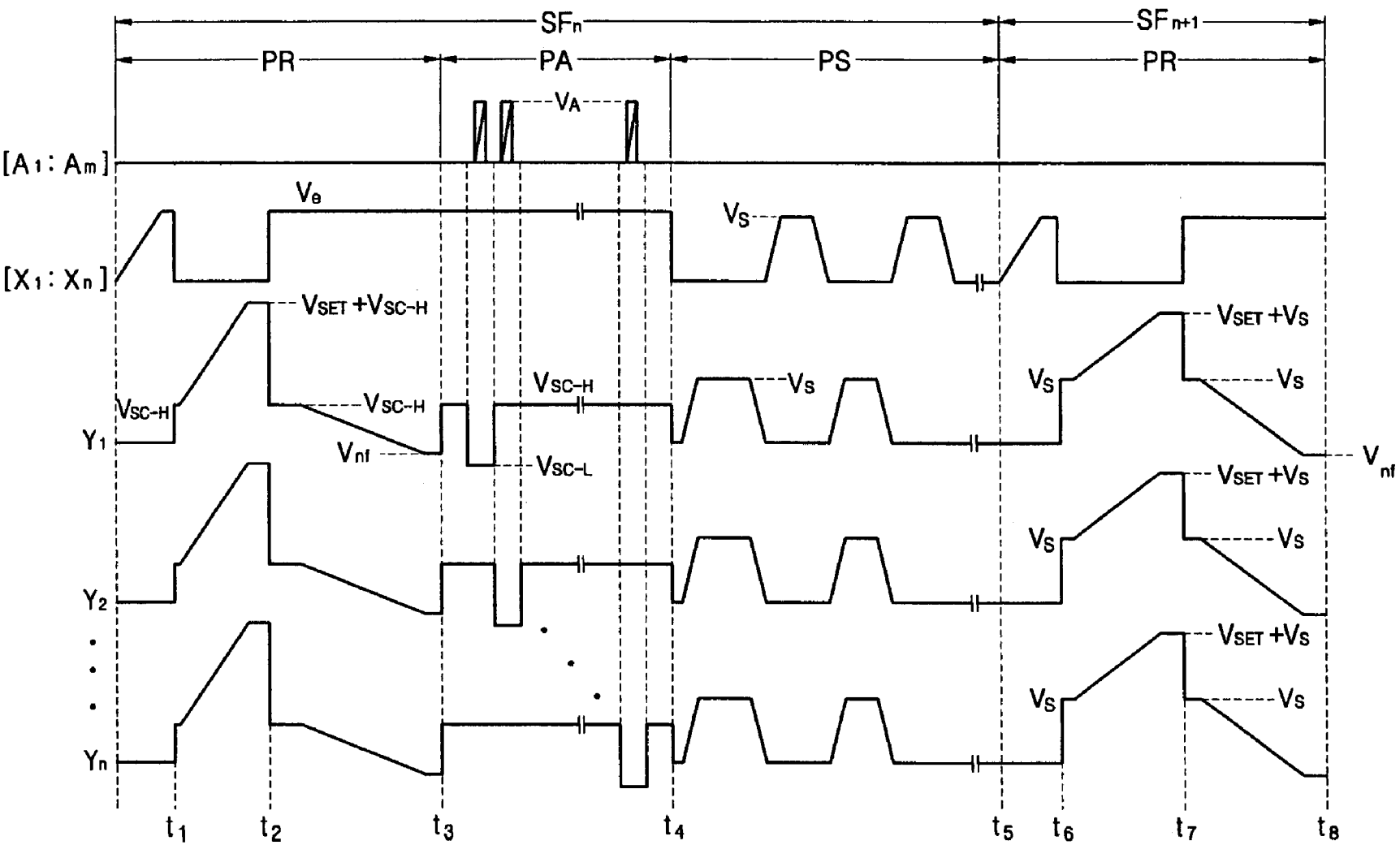
FIG. 6 is a timing diagram of a driving signal of driving a PDP according to an embodiment of the present invention.

Turning now to FIG. 6, FIG. 6 is a timing diagram of a driving signal for driving a PDP according to an embodiment of the present invention. Referring to FIG. 6, during a reset period PR, a reset pulse is applied to all groups of scanning lines so that write discharges are compulsorily performed, thus initializing the states of wall charges in all cells. The reset period PR is performed over the whole screen before an address period PA, so that the wall charges in all cells can be uniformly distributed. That is, between cells initialized during the reset period PR, the states of wall charges therein are similar.

During the reset period PR, a rising ramp pulse (between $t_1$ and $t_2$) is applied to Y electrode lines Y1, Y2, . . . , Yn so to perform a first initialization discharge, and then, a falling ramp pulse (between $t_2$ and $t_3$) is applied to the Y electrode lines Y1, Y2, . . . , Yn so to perform a second initialization discharge. The first initialization discharge means a phenomenon that a weak discharge is generated and simultaneously a large amount of negative charges are accumulated near the Y electrode lines Y1, Y2, . . . , Yn (i.e., near a dielectric layer on the Y electrode lines), while a rising ramp pulse $t_1$-$t_2$ with a gradual slope is applied to the Y electrode lines Y1, Y2, . . . , Yn. In order to reduce the time $t_1$-$t_2$ consumed for the first initialization discharge, the rising ramp pulse can be applied starting from a first voltage $V_{SC-H}$ as a predetermined reset start voltage. The rising ramp pulse rises to a maximum voltage $V_{SET}+V_{SC-H}$.

During the second initialization discharge, a falling ramp pulse is applied to the Y electrode lines Y1, Y2, . . . , Yn and thus some of the negative charges accumulated near the Y electrode lines Y1, Y2, . . . , Yn (i.e., near the dielectric layer on the Y electrode lines) are discharged, so that a weak discharge is generated. After the second initialization discharge, an amount of negative charges sufficient to generate an address discharge remains near the Y electrode lines Y1, Y2, . . . , Yn. Here, the falling ramp pulse applied to the Y electrode lines Y1, Y2, . . . , Yn must have a gradual slope not allowing any strong discharge. The falling ramp pulse is preferably applied after the maximum voltage $V_{SET}+V_{SC-H}$ is decreased to the first voltage $V_{SC-H}$ being a predetermined reset start voltage, in order to reduce the time $t_2$-$t_3$ consumed for the second initialization discharge. The falling ramp pulse falls from the first voltage $V_{SC-H}$ to a minimum voltage $V_{nf}$ where nf means "negative falling".

After the reset period PR is performed, the address period PA is performed. During the address period PA, address data is applied to address electrode lines A1, A2, . . . , Am and simultaneously a scan pulse changing between a scan high voltage $V_{SC-H}$ and a scan low voltage $V_{SC-L}$ are applied sequentially to the Y electrode lines Y1, Y2, . . . , Yn. That is, by simultaneously turning on Y electrode lines Y1, Y2, . . . , Yn and address electrode lines A1, A2, . . . , Am placed in the locations of cells to be displayed, address discharges are generated and display cells are selected. During the address period PA, the address discharges occur by an energy (i.e., sum of absolute values of all potentials) obtained by subtracting a sum of a scan low voltage $V_{SC-L}$ of a scanning pulse applied to the Y electrode lines and a potential formed by negative charges accumulated near the Y electrode lines, from a sum of a voltage Va of a display data signal applied to the address electrode lines A1, A2, . . . , Am and a potential formed by positive charges accumulated near the address electrode lines.

After the address period PA is performed, a sustain pulse is applied alternately to the X electrode lines X1, X2, . . . , Xn and the Y electrode lines Y1, Y2, . . . , Yn, so that a sustain discharge period PS occurs. During the sustain discharge period PS, a low voltage (ground potential) $V_G$ is applied to the address electrodes A1, A2, . . . , Am. The brightness of a PDP is controlled by the number of sustain pulses. As the number of sustain pulses provided in a sub-field or in a TV field increases, the brightness of the corresponding PDP also increases.

Now, operations performed during the sustain discharge period PS are described. During the sustain discharge period PS, the sustain pulse is applied so that positive charges are accumulated near the Y electrode lines and negative charges are accumulated near the X electrode lines. Then, if a sustain voltage $V_S$ is applied to the Y electrode lines, the positive charges accumulated near the Y electrode lines and the negative charges accumulated near the X electrode lines are discharged as space charges, so that a first sustain discharge is performed. The first sustain discharge occurs when a difference (sum of absolute values of all potentials) between a voltage of the negative charges accumulated near the X electrode lines and a sum of a sustain voltage $V_S$ and a voltage of the positive charges accumulated near the Y electrode lines exceeds a discharge start voltage. If the first sustain discharge occurs, negative charges are accumulated near the Y electrode lines and positive charges are accumulated near the X electrode lines.

If a sustain voltage $V_S$ is applied to the X electrode lines X1, X2, . . . , Xn after the first sustain discharge occurs, the positive charges accumulated near the X electrode lines and the negative charges accumulated near the Y electrode lines are discharged as space charges, so that a second sustain discharge is performed. The second sustain discharge occurs when a difference (sum of absolute values of all potentials) between the voltage of the negative charges accumulated near the scanning electrode lines and a sum of the sustain voltage $V_S$ applied to the X electrode X1, X2, . . . , Xn lines and the voltage of the positive charges accumulated near the X electrode lines exceeds the discharge start voltage. If the second sustain discharge occurs, positive charges are accumulated near the Y electrode lines and negative charges are accumulated near the X electrode lines, like before the first sustain discharge occurs. Thereafter, a third sustain discharge occurs in the same manner as the first sustain discharge and, then, a fourth sustain discharge occurs in the same manner as the second sustain discharge. These sustain discharges are successively generated by alternately applying a predetermined sustain pulse during periods assigned to respective sub-fields.

In the PDP driving method according to the embodiment of the present invention, by applying different reset start voltages to respective sub-fields, gray-scale levels are variously represented and the contrast of a displayed image can be enhanced. For example, a reset start voltage (e.g., $V_{SC-H}$) of a first type sub-field SFn can be lower than a reset start voltage (e.g., $V_S$) of a second type sub-field $SF_{n+1}$. In this case, in a unit discharge cell, reset light emitted when the first type sub-field $SF_n$ is reset-discharged is less than that emitted when the second type sub-field $SF_{n+1}$ is reset-discharged. This will be described later. For example, referring to FIG. 6, FIG. 6 illustrates a first type sub-field followed by a second type sub-field. As illustrated in FIG. 6, a reset start voltage of the first type sub-field $SF_n$ is $V_{SC-H}$ and a reset start voltage of the second type sub-field $SF_{n+1}$ is $V_S$.

Figure 7:
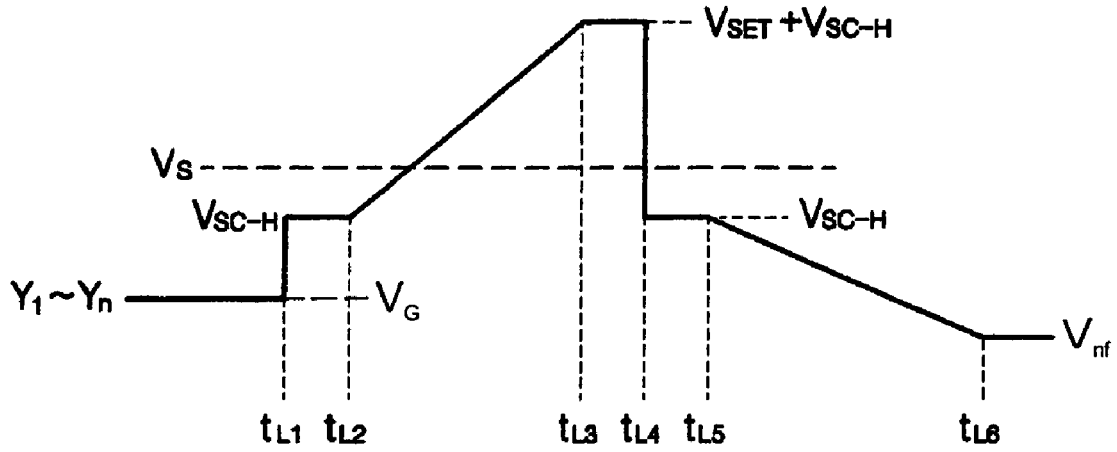
FIG. 7 is a timing diagram where a rising ramp pulse is applied starting from a reset start voltage $V_{SC-H}$ and a falling ramp pulse is applied starting from the reset start voltage $V_{SC-H}$ in a first type sub-field $S_{fn}$.
Figure 8:
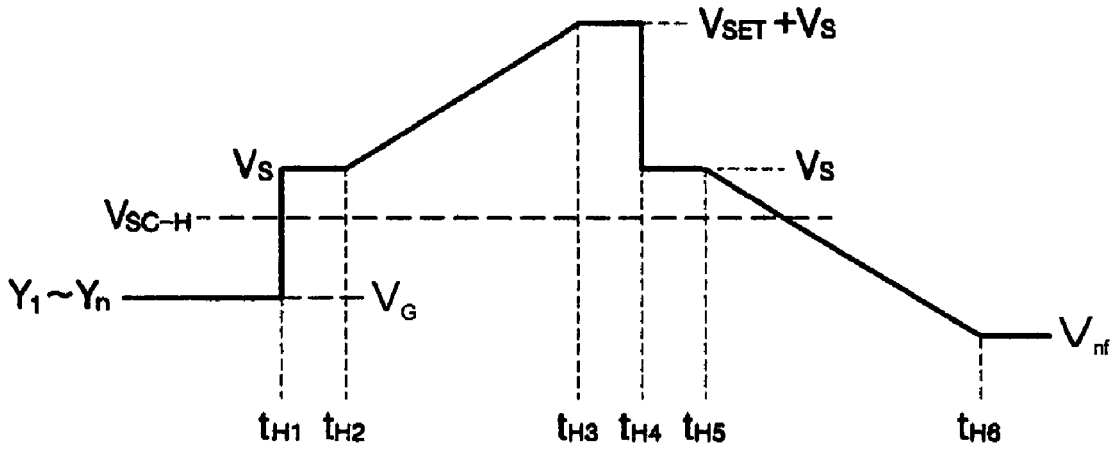
FIG. 8 is a timing diagram where a rising ramp pulse is applied starting from a reset start voltage $V_S$ and a falling ramp pulse is applied starting from the reset start voltage $V_S$, in a second type sub-field $SF_{n+1}$.

Turning to now FIGS. 7 and 8, FIGS. 7 and 8 illustrate the difference in voltage waveforms applied to the Y electrodes during the reset period PR for the first type sub-field and the second type sub-field. FIG. 7 is a timing diagram where a rising ramp pulse is applied starting from the reset start voltage $V_{SC-H}$ and a falling ramp pulse is applied starting from the reset start voltage $V_{SC-H}$, in the first type sub-field $SF_n$. FIG. 8 is a timing diagram where a rising ramp pulse is applied starting from the reset start voltage $V_S$ and a falling ramp pulse is applied starting from the reset start voltage $V_S$, in a second type sub-field $SF_{n+1}$. In the first type sub-field $SF_n$ and the second type sub-field $SF_{n+1}$, the rising ramp pulse and the falling ramp pulse applied starting from the reset start voltages $V_{SC-H}$ and $V_S$ must have gradual slopes so that a strong discharge will not occur.

According to an embodiment of the present invention, when measuring light intensity of a PDP being driven according to the timing diagrams illustrated in FIGS. 6 and 7, in the first type sub-field $SF_n$, if a reset start voltage is $V_{SC-H}$, light intensity of reset light is 0.2 Cd/m$^2$, light intensity of address light is 0.2 Cd/m$^2$, and light intensity of sustain light generated by a minimum sustain pulse allowing a sustain discharge is 0.4 Cd/m$^2$. Accordingly, the reset light of 0.2 Cd/m$^2$ is essentially generated from each discharge cell in each first type sub-field, the address light of 0.2 Cd/m$^2$ is selectively generated, and the sustain light of $0.4K\times2^{m-1}$ Cd/m$^2$ is generated when the address light is generated.

Also, when measuring light intensity of a PDP being driven according to the timing diagram illustrated in FIGS. 6 and 8, in the second type sub-field $SF_{n+1}$, if a reset start voltage is $V_S$, light intensity of reset light is 0.4 Cd/m$^2$, light intensity of address light is 0.2 Cd/m$^2$, and light intensity of sustain light generated by a minimum sustain pulse allowing a sustain discharge is 0.4 Cd/m$^2$. Accordingly, the reset light of 0.4 Cd/m$^2$ or 0.2 Cd/m$^2$ is selectively generated from each discharge cell depending on whether each sub-field is a first type or a second type, the address light of 0.2 Cd/m$^2$ is selectively generated, and the sustain light of $0.4K\times2^{m-1}$ Cd/m$^2$ is generated when the address light is generated. Therefore, discharge light intensity or brightness (or luminance or level of light) capable of representing gray-scale levels in a unit sub-field can be expressed by the following Equation 2:

$$F'(\text{gray level})=Fa(n)+F2(n)+F3(n) \qquad \text{Equation (2);}$$

where

Fa(n)=0.2×(R+1) Cd/m$^2$, where R=0 or 1

F2(n)=0.2 A Cd/m$^2$, where A=0 or 1

F3(n)=$0.4K\times2^{m-1}$ Cd/m$^2$, where K and m are weights corresponding to sub-fields Generally, eight or more unit sub-fields form one unit frame. A user sees an image through his/her eyes in actual brightness corresponding to a sum of light intensities and brightnesses emitted from respective unit sub-fields included in a unit frame (1 Frame).

For example, as illustrated in FIG. 2, in a unit frame consisting of 8 sub-fields, reset light Fa(n) of 8×0.2 Cd/m$^2$ or 8×0.4 Cd/m$^2$ is discharged depending on whether the sub-field is a first type or a second type, and address light F2(n) of 0.2 A Cd/m$^2$ is selectively discharged and sustain light F3(n) of $0.4K\times2^{m-1}$ Cd/m$^2$ is selectively discharged according to gray-scale levels.

Accordingly, in the method of driving PDP according to the present invention, since gray-scale levels can be represented by the reset light Fa(n) as well as by the address light and sustain light F2(n) and F3(n), differently from the technique of FIG. 3, it is possible to variously represent gray-scale levels. That is, in a unit sub-field, reset light F1(n) is a constant of 0.4 Cd/m$^2$ in the technique of FIG. 3, but in the method of driving a PDP according the present invention reset, reset light Fa(n) is a variable function of 0.2×(R+1) Cd/m$^2$ where R=0 or 1. Accordingly, if 8 sub-fields form one frame, gray-scale levels are represented by 8 combinations consisting of F2(n) and F3(n) in the technique of FIG. 3, but in the PDP driving method according to the present invention, 8 reset 2 light levels can be further selected by the reset light Fa(n) for each frame, so that gray-scale levels can be more variously represented.

For example, in a unit frame where the number of first type sub-fields of a low reset start voltage $V_{SC-H}$ is 8 and the number of second type sub-fields of a high reset start voltage $V_S$ is 0, reset light is 2×8+4×0=16 Cd/m$^2$. In a unit frame where the number of the first type sub-fields is 7 and the number of the second type sub-fields is 1, reset light is 2×7+4×1=18 Cd/m$^2$. In a unit frame where the number of the first type sub-fields is 6 and the number of the second type sub-fields is 2, reset light is 2×6+4×2=20 Cd/m$^2$. In a unit frame where the number of the first type sub-fields is 5 and the number of the second type sub-fields is 3, reset light is 2×5+4×3=22 Cd/m$^2$. In a unit frame where the number of the first type sub-fields is 4 and the number of the second type sub-fields is 4, reset light is 2×4+4×4=24 Cd/m$^2$. In a unit frame where the number of the first type sub-fields is 3 and the number of the second type sub-fields is 5, reset light is 2×3+4×5=26 Cd/m$^2$. In a unit frame where the number of the first type sub-fields is 2 and the number of the second type sub-fields is 6, reset light is 2×2+4×6=28 Cd/m$^2$. In a unit frame where the number of the first type sub-fields is 1 and the number of the second type sub-fields is 7, reset light is 2×1+4×7=30 Cd/m$^2$. In a unit frame where the number of the first type sub-fields is 0 and the number of the second type sub-fields is 8, reset light is 2×0+4×8=32 Cd/m$^2$.

In the present invention, each unit frame is made up of a plurality of sub-field, each with different gray-scale weights represented by pulses in the sustain discharge period. Each sub-field is also made up of some combination of first type sub-fields and second type sub-fields, the type indicating the start voltage in the reset period. Therefore, in the present invention, the user can control the intensity of light for a pixel by controlling both signals applied in the sustain discharge period and signals applied in the reset period. This is different than before where the reset period waveforms were not allowed to vary. Thus, with the method of the present invention, greater control over the displayable gray scale can be achieved. Also image contrast can be improved.

In the method of driving a PDP according to the present invention, since reset light can be selectively set in addition to the combinations of the address light and sustain light, the number of gray-scale levels capable of being represented increase 8 times. Also, the contrast of a displayed image is higher as black light can be made even darker. In the driving method of FIG. 3, since reset light of minimum 8×0.4 Cd/m$^2$ must be essentially emitted for each unit frame, black light is bright, which deteriorates the contrast of a displayed image.

However, according to the PDP driving method of the present invention, since a minimal value of reset light for each unit frame can be as low as 8×0.2 Cd/m$^2$, black light can be reduced by 50% with respect to the technique of FIG. 3 and the contrast of a displayed image can be increased by at least 2 times.

The method of driving a PDP according to the present invention can also be embodied as computer readable code on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, and optical data storage devices. The computer readable recording medium can also be distributed over network coupled computer systems so that the computer readable code is stored and executed in a distributed fashion.

In particular, the method of driving a PDP according to the present invention can be written in schematic or VHDL (Very high speed integrated circuit Hardware Description Language) and be executed by a programmable integrated circuit, for example, FPGA (Field Programmable Gate Array). The recording medium includes the programmable integrated circuit.

Figure 9:
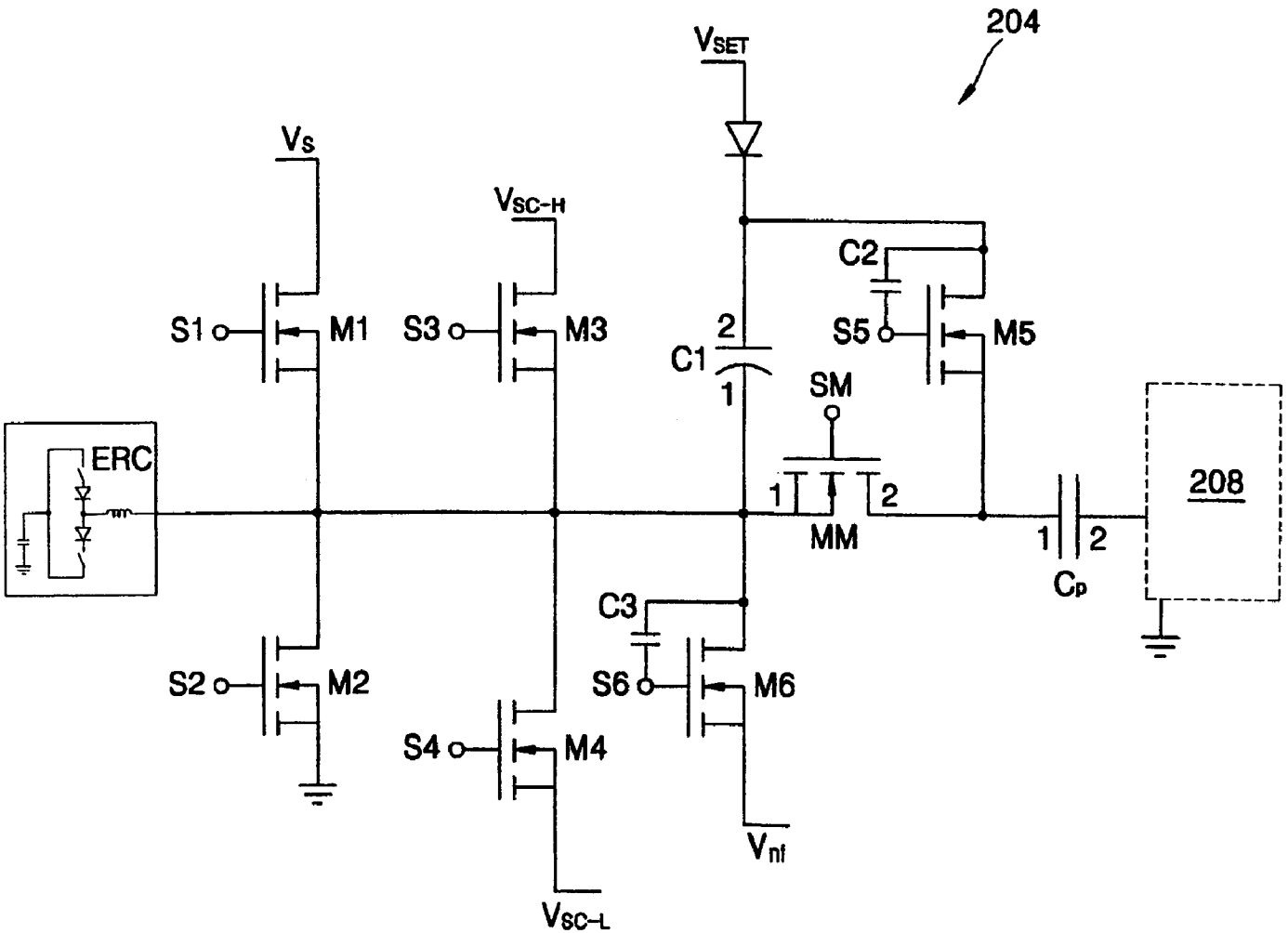
FIG. 9 is a circuit diagram of a driving apparatus employing a PDP driving method according to an embodiment of the present invention.

Turning now to FIG. 9, FIG. 9 is a circuit diagram of an apparatus of driving a PDP employing the method of driving a PDP according to an embodiment of the present invention. Referring to FIG. 9, a panel capacitor $C_P$ denotes panel capacitance created between Y electrode lines Y1, Y2, . . . , Yn and X electrode lines X1, X2, . . . , Xn of a PDP. A first terminal of the panel capacitor $C_P$ is connected to the Y electrode lines Y1, Y2, . . . , Yn and a second terminal of the panel capacitor $C_P$ is connected to the X electrode lines X1, X2, . . . , Xn. In FIG. 9, since a reset start voltage is a voltage applied to the Y electrode lines Y1, Y2, . . . , Yn according to the method of driving a PDP of the present invention (see FIG. 6), only a driving circuit of driving the Y electrode lines Y1, Y2, . . . , Yn is illustrated under the assumption that X electrode lines X1, X2, . . . , Xn are grounded.

Referring to FIG. 9, the first terminal of the panel capacitor $C_P$ is connected to a second terminal of a main switch MM of the Y electrode lines Y1, Y2, . . . , Yn. Also, a first switch M1 for switching a first power source ($V_S$), a second switch M2 for switching a second power source ($V_G$), a third switch M3 for switching a third power source ($V_{SC-H}$), a fourth switch M4 for switching a fourth power source ($V_{SC-L}$) and an energy recovery circuit (ERC) for accumulating charge from a discharge cell in a capacitor and outputting the accumulated charge to the discharge cell for energy recovery are connected to the first terminal of the main switch MM. A supply voltage $V_{SC-H}$ of the third power source is lower than a supply voltage $V_S$ of the first power source. The voltages $V_{SC-H}$, $V_{SC-L}$, $V_S$, $V_G$, $V_{set}$, and $V_{nf}$ illustrated in FIG. 9 are given for the convenience of understanding, and the present invention is not limited to these supply voltages illustrated in FIG. 9.

The first switch M1 and the second switch M2 allow a sustain voltage $V_S$ of the first power source and a ground voltage $V_G$ of the second power source to be alternately applied to the first terminal of the panel capacitor $C_P$ during a sustain-discharge period PS. The third switch M3 and the fourth switch M4 allow one of a scan high voltage $V_{SC-H}$ of the third power source and a scan low voltage $V_{SC-L}$ of the fourth power source to be selectively applied to the first terminal of the panel capacitor $C_P$ during an address period PA.

Also, a first capacitor C1 is connected between the first terminal of the main switch MM and the fifth power source ($V_{SET}$), and the fifth switch M5 is connected between the second terminal of the main switch MM and the fifth power source ($V_{SET}$). Also, a sixth switch M6 for switching a sixth power source ($V_{nf}$) is connected to the first terminal of the main switch MM. The fifth switch M5 and the sixth switch M6 flow constant current between their sources and drains, due to the influence of capacitors C2 and C3 connected respectively to the gates and sources of the fifth switch M5 and the sixth switch M6, thus passing a ramp-shaped voltage.

Now, the operation of a driving apparatus including the driving circuit illustrated in FIG. 9, according to an embodiment of the present invention will be described with reference to FIGS. 7 and 8. First, it is described how the driving apparatus of FIG. 9 operates during a reset period PR of a first type sub-field. Referring to FIGS. 7 and 9, during the reset period PR of the first type sub-field $SF_n$, only the second switch M2 and the main switch MM are turned on and all the remaining switches are turned off, so that a ground voltage $V_G$ is applied to the first terminal of the panel capacitor $C_P$. Thereafter, at a start time $t_{L1}$ of a reset pulse, the second switch M2 is turned off and simultaneously the third switch M3 is turned on while the main switch MM remains turned-on, so that a voltage $V_{SC-H}$ of the third power source is applied to the first terminal of the panel capacitor $C_P$.

Thereafter, at a start time $t_{L2}$ of a rising ramp pulse, the main switch MM is turned off and the fifth switch M5 is turned on. At this time, since a voltage $V_{SET}$ of the fifth power source is in advance charged in the second terminal of the first capacitor C1 and the third switch M3 remains turned on, a rising ramp-shaped pulse (between $t_{L2}$ and $t_{L3}$) rising from the voltage $V_{SC-H}$ of the third power source to a maximum voltage $V_{SET}+V_{SC-H}$ is applied to the first terminal of the panel capacitor $C_P$, so that first initialization discharges occur in discharge cells and a large amount of negative charges are accumulated near the Y electrodes. The rising ramp-shaped pulse (between $t_{L2}$ and $t_{L3}$) has a predetermined slope continuously allowing a weak discharge without allowing any strong discharge.

At a time $t_{L4}$ after which the maximum voltage $V_{SET}+V_{SC-H}$ is maintained during a predetermined time, the fifth switch M5 is turned off and the main switch MM is turned on while the third switch M3 remains turned-on, so that the voltage $V_{SC-H}$ of the third power source is applied to the first terminal of the panel capacitor $C_P$.

Thereafter, at a start time $t_{L5}$ of a falling ramp pulse (between $t_{L5}$ and $t_{L6}$), the third switch M3 is turned off and the sixth switch M6 is turned on, so that a falling ramp pulse (between $t_{L5}$ and $t_{L6}$) falling to the voltage $V_{nf}$ of the sixth power source is applied to the first terminal of the panel capacitor $C_P$. Thus, second initialization discharges occur in the discharge cells and some negative discharges are discharged near the Y electrodes, so that the negative charges accumulated near all the Y electrodes are uniformly distributed. Here, the falling ramp pulse (between $t_{L5}$ and $t_{L6}$) has a predetermined slope continuously allowing a weak discharge without allowing any strong discharge.

During the first type sub-field $SF_n$ which is performed by the driving apparatus of FIG. 9, in each discharge cell, reset light of 0.2 Cd/m$^2$ is essentially generated by applying a reset start voltage $V_{SC-H}$ output from the third power source, address light of 0.2 Cd/m$^2$ is selectively generated, and sustain light of 0.4K×2$^{m-1}$ Cd/m$^2$ is generated when the address light is generated.

Next, it is described how the driving apparatus operates during a reset period PR of a second type sub-field $SF_{n+1}$.

First, referring to FIGS. 8 and 9, during the reset period PR of the second type sub-field $SF_{n+1}$, only the second switch M2 and the main switch MM are turned on and all the remaining switches are turned off, so that a ground voltage $V_G$ is applied to a first terminal of the panel capacitor $C_P$. Successively, at a start time $t_{H1}$ of a reset pulse, the second switch M2 is turned off and simultaneously the first switch M1 is turned on while the main switch MM remains turned-on, so that the voltage $V_S$ of the first power source is applied to the first terminal of the panel capacitor $C_P$.

Thereafter, at a start time $t_{H2}$ of the rising ramp pulse, the main switch MM is turned off and the fifth switch M5 is turned on. At this time, since the voltage $V_{SET}$ of the fifth power source is in advance charged in the second terminal of the first capacitor C1 with the first switch M1 turned on, a rising ramp pulse (between $t_{H2}$ and $t_{H3}$) rising from the voltage $V_S$ of the first power source to the maximum voltage $V_{SET}+V_S$ is applied to the first terminal of the panel capacitor $C_P$ so that first initialization discharges occur in discharge cells and a large amount of negative charges are accumulated near the Y electrodes. At this time, the rising ramp pulse (between $t_{H2}$ and $t_{H3}$) has a predetermined slope continuously allowing a weak discharge without allowing any strong discharge.

At a time $t_{H4}$ before which the maximum voltage $V_{SET}+V_S$ is maintained for a predetermined period, the fifth switch M5 is turned off and the main switch MM is turned on while the first switch M1 remains turned-on, so that the voltage $V_S$ of the first power source is applied to the first terminal of the panel capacitor $C_P$.

Thereafter, at a time $t_{H5}$, the first switch M1 is turned off and the sixth switch M6 is turned on, so that a falling ramp pulse falling to the voltage $V_{nf}$ of the sixth power source is applied to the first terminal of the panel capacitor $C_P$. Thus, second initialization discharges occur in the discharge cells and some negative charges are discharged near the Y electrodes, so that negative charges are uniformly distributed near all the Y electrodes. At this time, the falling ramp pulse $t_{H5}$-$t_{H6}$ has a predetermined slope continuously allowing a weak discharge without allowing any strong discharge.

During the second type sub-field $SF_{n+1}$ which is driven by the driving apparatus, in each discharge cell, by applying a reset start voltage $V_S$ output from the first power source, reset light of 0.4 Cd/m$^2$ is essentially generated, address light of 0.2 Cd/m$^2$ is selectively generated, and sustain light of 0.4K×$2^{m-1}$ Cd/m$^2$ is generated when the address light is generated. Therefore, in the apparatus of driving a PDP according to the present invention, by selectively changing a reset start voltage during a reset period PR, it is possible to expand the representation range of gray-scale levels 8 times.

As described above, the method of driving a PDP according to the present invention has the following effects. First, since reset light of a PDP can be selectively decided, it is possible have more diversity and more finely represent gray-scale levels than when only combinations of address light and sustain light are used.

Second, in the PDP driving method of FIG. 3, since reset light of minimum 8×0.4 Cd/m$^2$ must be essentially discharged for each unit frame, the contrast of a displayed image is poor. However, in the method of driving a PDP according to the present invention, since a minimal value of reset light assigned to each unit frame is reduced to 8×0.2 Cd/m$^2$ and hence the brightness of black light is reduced by 50% compared to that of the technique of FIG. 3, the contrast of a displayed image can be remarkably improved.

Third, in the method of driving a PDP according to the present invention, it is possible to easily control light intensity of reset light by merely adjusting a reset start voltage, thus effectively and finely displaying images in low gray-scale through a slight difference in reset light intensities.

While the present invention has been particularly illustrated and described with reference to exemplary embodiments thereof, it will be understood by those of ordinary skill in the art that various changes in form and details may be made therein without departing from the spirit and scope of the present invention as defined by the following claims.

what is claimed is:

1. A method of driving a plasma display panel (PDP), comprising:

providing the PDP that comprises address electrodes, first electrodes and second electrodes intersecting the address electrodes, gray-scale levels being represented by combinations of sub-fields that include combinations of first type sub-fields and second type sub-fields, each sub-field comprising a reset period, an address period, and a sustain-discharge period;

applying a rising ramp-shaped pulse to the first electrodes during each reset period, the rising ramp-shaped pulse starting from a reset start voltage;

applying a falling ramp-shaped pulse to the first electrodes during each reset period after the application of the rising ramp-shaped pulse, the falling ramp-shaped pulse starting at the reset start voltage, a reset start voltage of the first type sub-field being lower than the reset start voltage of the second type sub-field;

applying address data to the address electrodes during each address period while applying a scan pulse sequentially to the first electrodes causing an address discharge to occur in selected discharge cells, the scan pulse being between a scan high voltage and a scan low voltage; and applying a pulse of a sustain voltage alternately to the first electrodes and the second electrodes during each sustain-discharge period causing a sustain discharge to occur in the selected discharge cells.

2. The method of claim 1, the reset start voltage of the second type sub-field being equal to the sustain voltage.

3. The method of claim 2, the reset start voltage of the first type sub-field being equal to the scan high voltage.

4. The method of claim 3, in each discharge cell, reset light emitted during reset period of the first type sub-field being less than reset light emitted during reset period of the second type sub-field.

5. The method of claim 4, in the discharge cells, when a minimum level of light (i.e., luminance) emitted during the sustain-discharge period is 4 units, a level of light emitted during the address period is 2 units, a level of light emitted during the reset period of the second type sub-field is 4 units, and a level of light emitted during the reset period of the first type sub-field is less than 4 units.

6. The method of claim 5, the level of light emitted during the reset period of the first type sub-field being 2 units.

7. The method of claim 6, an image of a unit frame is created by combinations of first type sub-fields and second type sub-fields, and brightness of light emitted per each unit frame is based on an amount of first type sub-fields and second type sub-fields in a unit frame and on selective combinations of address light and sustain light.

8. The method of claim 1, in the first type sub-field and in the second type sub-field, the rising ramp-shaped pulse and the falling ramp-shaped pulse applied starting from the reset start voltage have predetermined slopes not allowing any strong discharge.

9. A program storage device readable by a machine, tangibly embodying a program of instructions executable by the machine to perform a method of driving a plasma display panel (PDP), the method comprising:

providing the PDP that comprises address electrodes, first electrodes and second electrodes intersecting the address electrodes, gray-scale levels being represented by combinations of first type sub-fields and second type sub-fields, each sub-field comprising a reset period, an address period, and a sustain-discharge period;

applying a rising ramp-shaped pulse to the first electrodes during each reset period, the rising ramp-shaped pulse starting from a reset start voltage;

applying a falling ramp-shaped pulse to the first electrodes during each reset period after the application of the rising ramp-shaped pulse, the falling ramp-shaped pulse starting at the reset start voltage, a reset start voltage of a first type sub-field being lower than the reset start voltage of a second type sub-field;

applying address data to the address electrodes during each address period while applying a scan pulse sequentially to the first electrodes causing an address discharge to occur in selected discharge cells, the scan pulse being between a scan high voltage and a scan low voltage; and applying a pulse of a sustain voltage alternately to the first electrodes and the second electrodes during each sustain-discharge period causing a sustain discharge to occur in the selected discharge cells.

10. The program storage device of claim 9, the reset start voltage of the second type sub-field being equal to the sustain voltage.

11. The program storage device of claim 10, the reset start voltage of the first type sub-field being equal to the scan high voltage.

12. The program storage device of claim 11, in each discharge cell, reset light emitted during the reset period of the first type sub-field being less than reset light emitted during the reset period of the second type sub-field.

13. The program storage device of claim 12, in the discharge cells, when a minimum level of light (i.e., luminance) emitted during the sustain-discharge period is 4 units, a level of light emitted during the address period is 2 units, a level of light emitted during the reset period of the second type sub-field is 4 units, and a level of light emitted during the reset period of the first type sub-field is less than 4 units.

14. The program storage device of claim 13, the level of the reset light emitted during the reset period of the first type sub-field is 2 units.

15. The program storage device of claim 14, an image of a unit frame is created by combinations of first type sub-fields and second type sub-fields, and brightness of light emitted per each unit frame is based on an amount of first type sub-fields and second type sub-fields in a unit frame and on selective combinations of address light and sustain-discharge light.

16. The program storage device of claim 9, in the first type sub-field and in the second type sub-field, the rising ramp-shaped pulse and the falling ramp-shaped pulse applied staffing from the reset start voltage have predetermined slopes not allowing any strong discharge.

17. An apparatus of driving a plasma display panel (PDP), comprising:

a main switch connected to a first electrode of the PDP;

first, second, third, and fourth switches, each being connected to a first terminal of the main switch and being configured to switch first, second, third, and fourth power sources, respectively;

a fifth power source;

a first capacitor connected between said first terminal of the main switch and the fifth power source;

a fifth switch connected between a second and opposite terminal of the main switch and the fifth power source;

a sixth switch connected between the first terminal of the main switch and a sixth power source, the sixth switch being configured to switch a sixth power source; and a controller adapted to, during a reset period, turn on one of the first switch and the third switch while keeping the other of the first switch and the third switch along with the second switch, the fourth switch and the sixth switch turned off, the controller also being adapted to, during an address period, selectively turn on and off the third and the fourth switch, and during a sustain-discharge period, alternately turn on and off the first and the second switch.

18. The apparatus of claim 17, a voltage of the third power source being lower than that of the first power source.

19. The apparatus of claim 18, a voltage of the first power source is the same as a sustain voltage.

20. The apparatus of claim 18, a voltage of the third power source is the same as a scan high voltage.

* * * * *